US007757850B2

(12) United States Patent
Krizan et al.

(10) Patent No.: US 7,757,850 B2
(45) Date of Patent: Jul. 20, 2010

(54) MONITOR TRANSPORTING SYSTEM

(76) Inventors: Dennis Theodore Krizan, 6018 W. National Ave., West Allis, WI (US) 53214; Jon T. Erickson, N69W6459 Bridge Rd., Cedarburg, WI (US) 53012

( * ) Notice: Subject to any disclaimer, the term of this patent is extended or adjusted under 35 U.S.C. 154(b) by 124 days.

(21) Appl. No.: 12/009,593

(22) Filed: Jan. 22, 2008

(65) Prior Publication Data

US 2009/0184013 A1 Jul. 23, 2009

(51) Int. Cl.
*B65D 85/00* (2006.01)

(52) U.S. Cl. ..... 206/320; 206/594; 206/591; 206/521

(58) Field of Classification Search ..... 206/320, 206/701, 521, 451, 449, 586, 720, 724, 466, 206/469, 484.1, 591, 455, 456, 587, 592, 206/594; 410/60, 63, 87; 383/121.1; D3/218, D3/272

See application file for complete search history.

(56) References Cited

U.S. PATENT DOCUMENTS

| | | | | |
|---|---|---|---|---|
| 5,678,666 | A * | 10/1997 | Shyr et al. | 190/102 |
| 7,293,635 | B2 * | 11/2007 | Repke et al. | 190/109 |
| 7,540,378 | B2 * | 6/2009 | Gallagher | 206/320 |
| 2002/0144925 | A1 * | 10/2002 | Busch | 206/524.2 |
| 2003/0196923 | A1 * | 10/2003 | Decroix | 206/386 |

FOREIGN PATENT DOCUMENTS

GB 2000101 A * 1/1979

* cited by examiner

*Primary Examiner*—Mickey Yu
*Assistant Examiner*—Rafael Ortiz

(57) ABSTRACT

Protective soft cushioned bag providing hand holds to safely contain, protect and carry a monitor or load of varying sizes and weights from the original site of the monitor or load to the rigid protective rectangular exoskeleton shell for transportation to another location or secure storage and vise versa.

1 Claim, 8 Drawing Sheets

MONITOR TRANSPORTING SYSTEM

BACKGROUND OF THE INVENTION

The present invention relates to an improvement of a protective bag and hard shell system to properly and safely carry, transport and store a thin, fragile monitor or load of varying sizes. The disadvantage with existing systems is none can safely carry a thin, fragile, expensive monitor or load of varying lengths, sizes and weights, whether it is Liquid Crystal Display (LCD), Light Emitting Diode (LED), Plasma, Digital Light Processing (DLP), Laser or an unknown technology yet to come. These are all a rather new technology, explaining why no proper carrying and storage system has been invented until ours. Until the inconvenience of properly carrying, transporting, protecting and storing a thin, fragile, expensive monitor or load of varying lengths, sizes and weights is solved, people will need to continue carrying them by hand, using improper hand holds if any, cover them with cloth or blankets, balance them on a conventional cart, risk scratching the surface, risk slipping improper grip or hand holds, risk damage in storage or risk damage during vehicle transportation by poor tie down systems if any, foreign objects sliding or falling against it from turning or vehicle vibration. The larger units can weigh over 100 pounds with no proper hand holds and all monitors are fragile, presenting a risk of damage and scratching the units and or the fragile, delicate and or expensive building surroundings and or to the person or persons carrying it, during moving or transporting the fragile load too and from it's two or more points of location. This will continue to cost more in company expenses to absorb losses including: insurance claims for damaged units; building floor, wall, and doorway surfaces; and workers compensation claims for workers injured improperly carrying the units.

SUMMARY OF THE INVENTION

In order to rectify the existing disadvantages of the conventional or none existent system of protecting, carrying, transporting and storing a thin, fragile monitor or load of varying sizes and weights as described, the applicants have been consistently and continuously making efforts to develop and improve the type of system required for this need. With the applicants' accumulated experience and intelligent skills in the field, the applicants finally devised protective bag and hard shell system to properly and safely carry, transport and store a thin, fragile monitor or load of varying sizes and weights in an upright position.

It is an object of the present invention to provide a protective bag that provides proper hand holds no matter what the load provides if anything and to provide a heavily cushioned platform or base, medium cushioned lower end and thinly cushioned and more flexible upper end of bag to better conform to the shape and size of the load to better protect the monitor or load of varying sizes and weights and to better protect the surroundings the bag and load are carried through and with tapered ends to help the bag slide into the protective shell.

It is another object of the present invention to provide a hard shell or exoskeleton system that can be secured to the inside of a vehicle or stacked in a warehouse or shop to properly and safely hold the protective bag containing a thin, fragile monitor or load of varying sizes and weights in an upright position for safe, secure and proper vehicle transport and warehousing or shop storage of the bag and load with rounded side vertical support frame tubes to assist the bag and loads sliding in.

It is a further object of the present invention of a protective bag and hard shell exoskeleton system to be made of a strong enough and lightweight enough material to hold the load safely and minimize weight. Keeping assembly to a minimum to reduce production and shipping costs.

SPECIFICATION OR DETAILED DESCRIPTION OF THE PREFERRED EMBODIMENT

Figure 1:
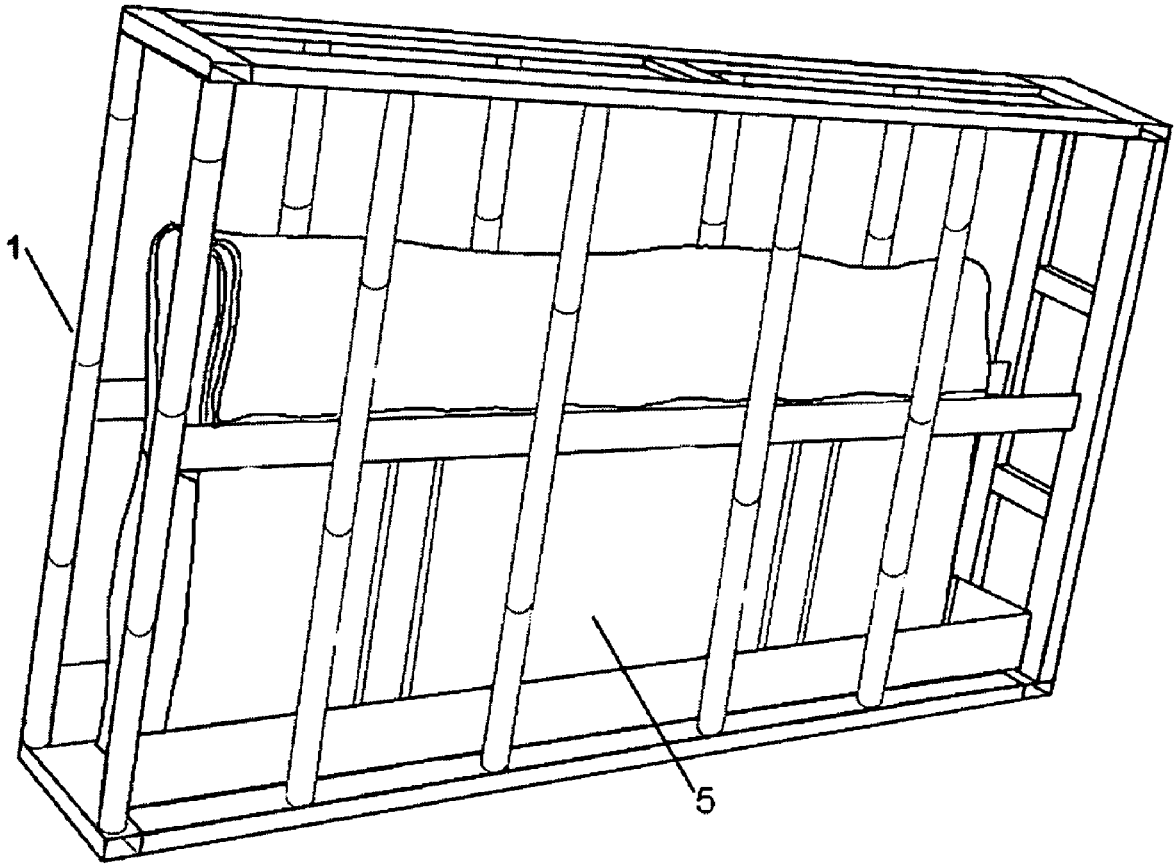
FIG. 1 is a three dimensional, side perspective view of the Monitor Transporting system showing the soft cushioned bag fully inserted in the rigid protective exoskeleton shell according to the present invention.

FIG. 1 shows a complete Monitor Transporting System according to a preferred embodiment of the present invention wherein the soft cushioned bag (5) is fully inserted into the rigid protective exoskeleton shell (1) by sliding in with the aid of lower side guides (2), upper side guides (3) and rounded vertical rigid frame supports (1*a*) to avoid the soft cushioned bag from catching on the frame of the rigid protective shell.

Figure 2:
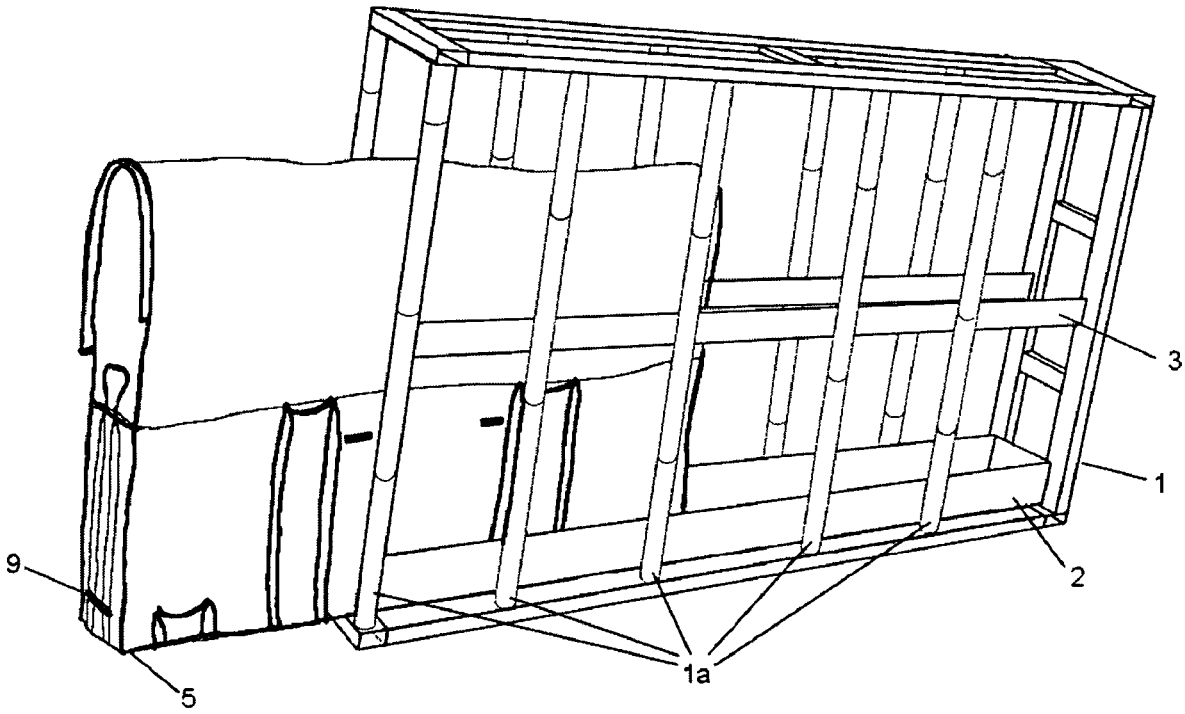
FIG. 2 is a three dimensional, side perspective view of the Monitor Transporting system showing the soft cushioned bag partly inserted or retracted from the rigid protective exoskeleton shell according to the present invention.

FIG. 2 shows the Monitor Transporting System according to a preferred embodiment of the present invention wherein the soft cushioned bag (5) is partly inserted into or retracted from the rigid protective exoskeleton shell (1) with the aid of handle (9) for pulling the bag from the rigid frame or by sliding in or out with the aid of lower side guides (2), upper side guides (3) and rounded vertical rigid frame supports vertical rounded tubular frame sections (1*a*) to avoid the soft cushioned bag from catching on the frame of the rigid protective shell.

Figure 3:
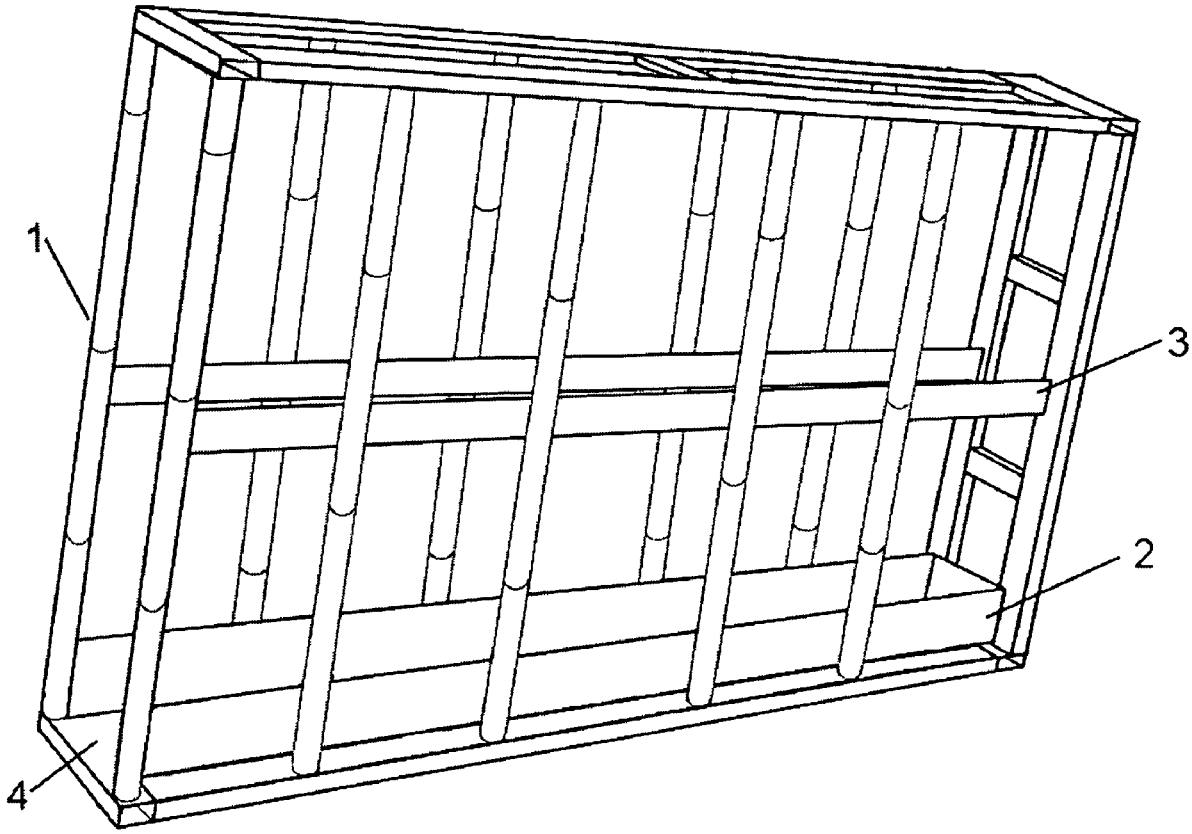
FIG. 3 is a three dimensional, side perspective view of the rigid protective exoskeleton shell according to the present invention.

FIG. 3 shows the rigid protective shell according to a preferred embodiment of the present invention wherein the soft cushioned bag is not in the rigid protective exoskeleton shell (1) revealing the lower bag guides (2) the upper bag guides (3) and the bottom slide plate (4) for sliding the soft cushioned bag and load in or out.

Figure 4:
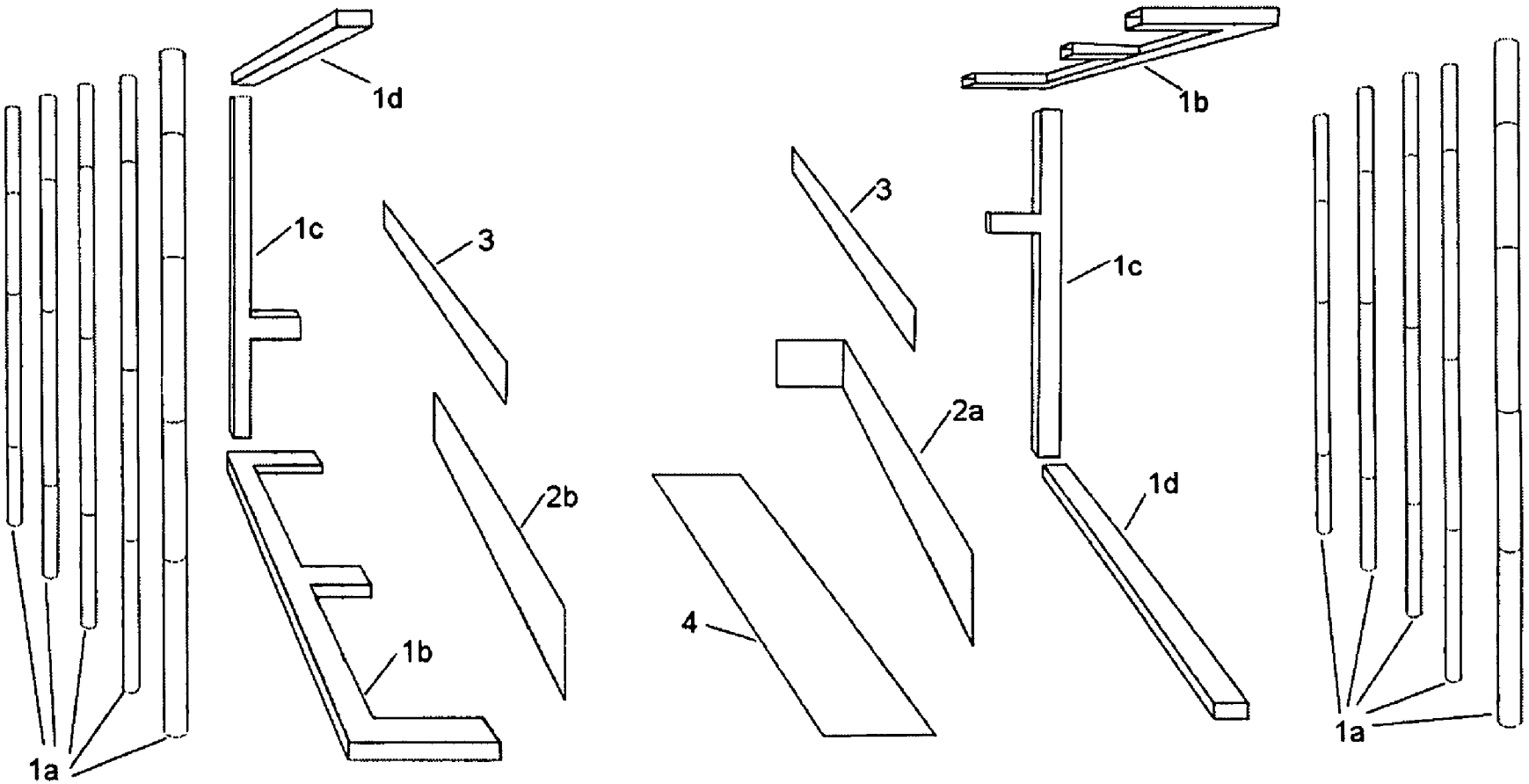
FIG. 4 is a three dimensional, exploded view of the rigid protective exoskeleton shell according to the present invention.

FIG. 4 shows an exploded view of the empty rigid protective exoskeleton shell (1). Visible are the bottom slide plate (4) for sliding the soft cushioned bag onto, the upper and lower section of the frame (1*b*) and (1*d*), the back or rear of the frame or shell (1*c*) and the lower (2*a*) and (2*b*) and upper (3) side guides and vertical rounded tubular frame sections (1*a*) to help the soft cushioned bag and load to slide in without catching on sharp corners.

Figure 5:
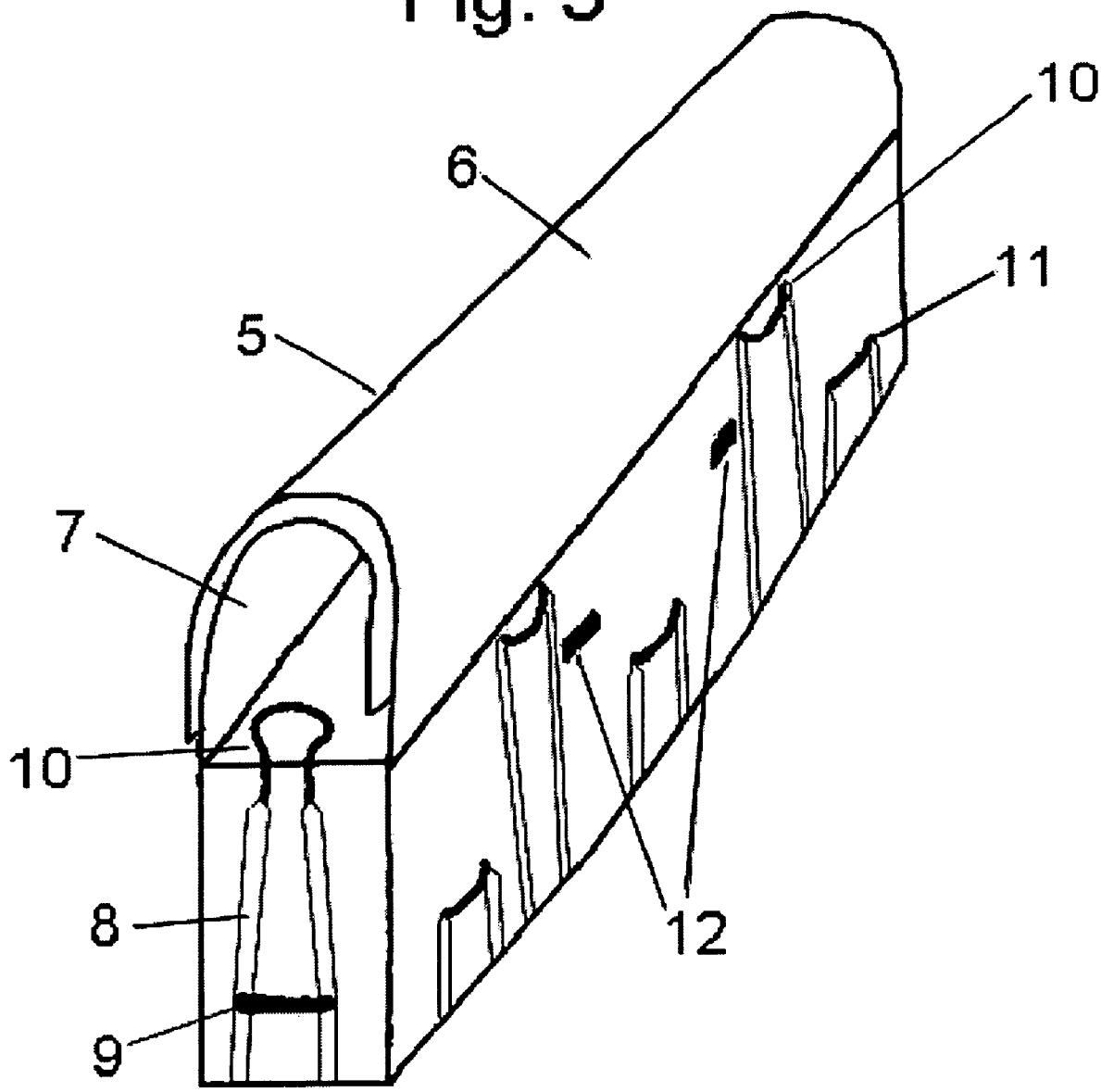
FIG. 5 is a three dimensional, side end perspective view of the soft cushioned bag according to the present invention.

FIG. 5 shows the soft cushioned bag (5) wherein visible are; outside bag material (6) is of a durable water resistant flexible material, inside lining bag material (7) is of a soft very flexible material to help prevent scratching the load or monitor, handle strapping material (8) runs from one handle to the opposite handle for extra strength, pull handle (9) for pulling the bag from the rigid protective shell, carrying handle (10) for carrying bag with load having a proper center of gravity to help keep the load and bag in an upright or vertical position while carrying and lower handles (11) for maneuvering the bag with load for loading, unloading and positioning and adjustable load securing straps (12) that travel through one side of the bag to the other near each end to help secure and center the load or monitor within the bag.

Figure 6:
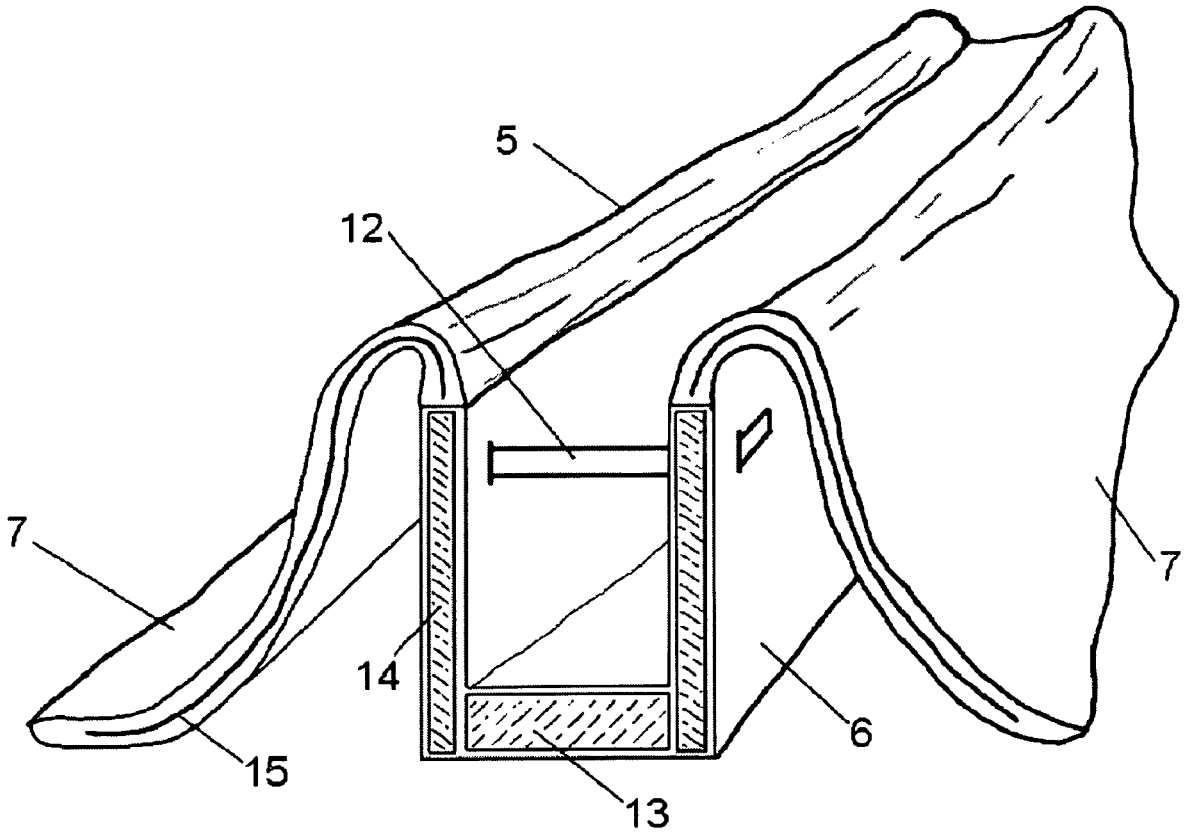
FIG. 6 is a three dimensional, side end perspective cutaway view of the soft cushioned bag according to the present invention.

FIG. 6 shows a cutaway view of the soft cushioned bag (5) wherein visible are; outside bag material (6) is of a durable water resistant flexible material, inside bag lining material (7) is of a soft very flexible material to help prevent scratching the load or monitor, adjustable load securing straps (12) that travel through one side of the bag to the other near each end to help secure and center the load or monitor within the bag, heavy rigid bottom cushion (13) to protect the load or monitor within the bag from bottom damage or screen damage due to bottom shock, medium semi rigid lower side cushions (14) to protect the internal load or monitor from damage due to side shock and thin flexible upper cushion (15) that can easily lay or flap over the load or monitor to protect the upper section of the load or monitor from dings, scratches and weather.

Figure 7:
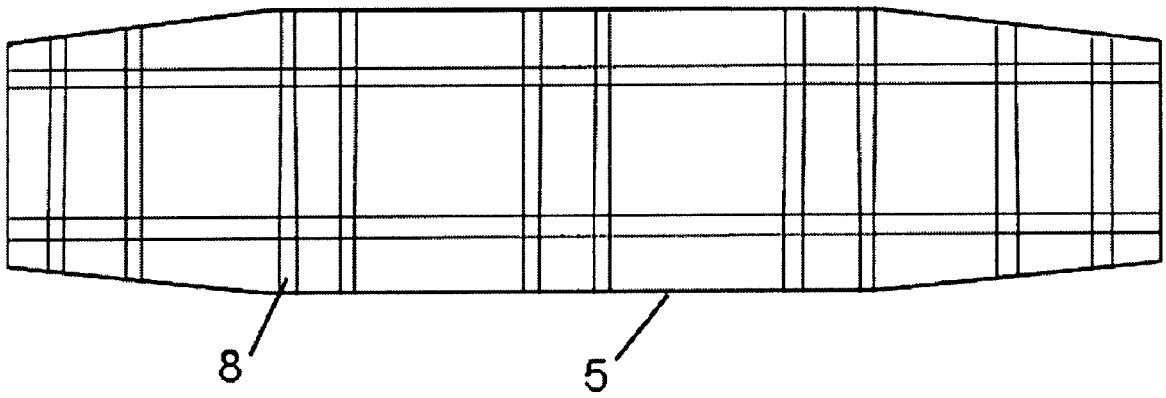
FIG. 7 is a two dimensional, bottom view of the soft cushioned bag showing the torpedo or tapered shape of the soft cushioned bag according to the present invention.

FIG. 7 shows the bottom of the soft cushioned bag (5) wherein the handle strapping (8) runs from one handle to the opposite handle for extra strength and the torpedo or tapered shape of the bag for easier loading into and to avoid catching on sharp edges of the rigid protective shell.

Figure 8:
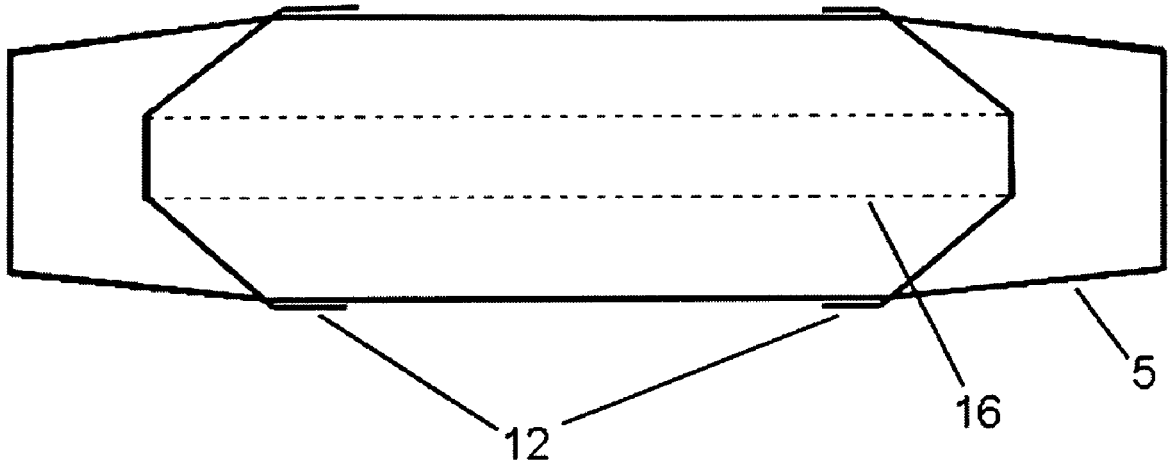
FIG. 8 is a two dimensional, top view of the soft cushioned bag showing the internal load or monitor straps within the soft cushioned bag according to the present invention.

FIG. 8 shows an upper view looking down into the soft cushioned bag (5) wherein the adjustable load securing straps (12) that travel through one side of the bag to the other near each end to help secure and center the load or monitor (16) within the bag can be seen.

FIELD OF THE PRESENT INVENTION

The present invention relates to a soft cushioned bag and rigid rectangular shell to safely transport thin, fragile monitors of varying size. The bag and rigid shell of the present invention is a novel, practical and safe transportation and storage means, protecting from damage and scratches which has the advantages of easy operation, simple in construction and suitable for safely carrying, transporting and storing monitors and fragile loads of various weights and sizes. The monitor or load can be taken right from its place of origin, placed in the bag, carried using the hand holds provided by the bag too and placed in the rigid rectangular shell for further transport or storage. The rigid shell can be used for safe protective storage of the monitor or load in a building for storage protection or in a vehicle for further transport protection.

What is claimed is:

1. A soft cushioned transport storage bag and rigid protective exoskeleton shell for moving and transporting a flat panel plasma, LCD or thin fragile monitors or equivalent fragile rectangular loads safely; the bag comprising:

an inner lining of a soft very flexible load and screen protecting non scratching material;

a rigid, heavy or thick bottom cushion for adequate bottom impact or shock protection of the load during loading, unloading, transport, dragging or storage; medium semi rigid lower side cushions for adequate side impact shock protection of the load;

thin flexible shape or load conforming upper cushions or padding being very flexible for load conforming that conform to the size and shape of the load for protection of the top of the load;

an outer layer of a durable water resistant flexible material to keep the load protected from the outside elements, impact or shock;

hand holds or handles for carrying, controlling, loading and removing said bag and load comprising:

at least two handles, each of said handles located on opposing upper regions of said bag for carrying optional multiple side handles or hand holds high and or low distributed along length of said bag on each side for carrying, controlling, loading and removing said bag, one optional handle low or near the bottom on each end of said bag for controlling, loading, removing said bag and pulling said bag from said exoskeleton shell;

optional strapping material that runs along a bottom of said bag from one handle to an opposite handle on said upper regions of said bag for extra strength and support of the handles and bottom of said bag; and said bottom of said bag having tapered end portions;

a vertical rigid tubular frame support exoskeleton shell comprising:

two rows of spaced apart rounded rigid vertical tubes to facilitate the said rows of tubes defining a chamber of said shell for loading and unloading of said bag and prevention of said bag catching on vertical supports of said protective exoskeleton and;

optional lower and or center bag guides extending along both said rows of tubes of the length of said exoskeleton shell to facilitate the loading and prevention of said bag catching on vertical tubes of said protective exoskeleton shell.

* * * * *